United States Patent [19]

Dumond

[11] 4,226,331

[45] Oct. 7, 1980

[54] HYDRAULICALLY ACTUATED HOIST FOR TRACTORS HAVING A CONVENTIONAL THREE POINT HITCH

[76] Inventor: Duane I. Dumond, 2309 Parmenter Rd., Corunna, Mich. 48817

[21] Appl. No.: 822,536

[22] Filed: Aug. 8, 1977

[51] Int. Cl.[2] ..... B66C 23/06; 414/681-687 681-687;607;713;406;546-550;555-558

[52] U.S. Cl. ..... 212/258; 212/261; 212/264; 212/189; 414/686; 280/461 A; 212/244

[58] Field of Search ..... 212/8 R, 8 B, 9, 55-59 R, 212/144-145; 214/131 R, 131 A, 620, 766, 77 R; 280/461 R, 461 A, 763; 172/272, 274; 607; 713; 406; 546-550; 555-558

[56] References Cited

U.S. PATENT DOCUMENTS

| | | | |
|---|---|---|---|
| 2,867,333 | 1/1959 | DeShano | 212/55 X |
| 3,047,160 | 7/1962 | Paul | 212/55 X |
| 3,362,554 | 1/1968 | Fortier | 214/766 |
| 3,374,901 | 3/1968 | Ferwerda | 212/59 R |
| 3,848,751 | 11/1974 | Holland | 212/56 |
| 4,069,922 | 1/1978 | Hawking | 212/59 R |

FOREIGN PATENT DOCUMENTS

| | | | |
|---|---|---|---|
| 811000 | 4/1969 | Canada | 212/59 R |
| 2112534 | 10/1971 | Fed. Rep. of Germany | 212/55 |
| 41820 | 10/1969 | Finland | 214/131 A |
| 1289522 | 12/1962 | France | 214/766 |

*Primary Examiner*—Stephen G. Kunin
*Assistant Examiner*—R. B. Johnson
*Attorney, Agent, or Firm*—Malcolm R. McKinnon

[57] ABSTRACT

A hydraulically actuated hoist adapted for mounting on a farm tractor, the hoist including a base of generally inverted T-shaped configuration having a horizontally extending portion and a vertically extending portion, a telescopic boom having one end portion pivotally connected to the vertically extending portion of the base, the hoist also including a pair of downwardly extending support legs fixed to the horizontally extending portion of the base, and an elongate support post pivotally connected to the end portion of the boom remote from the base, the post being adapted to overlie the boom and being pivotable to a vertically extending position whereby the post and the legs cooperate to form a tripodal support for the hoist.

4 Claims, 5 Drawing Figures

HYDRAULICALLY ACTUATED HOIST FOR TRACTORS HAVING A CONVENTIONAL THREE POINT HITCH

BRIEF SUMMARY OF THE INVENTION

This invention relates to hoists, and, more particularly, to an improved hydraulically actuated hoist particularly adapted for use with tractors, such as farm tractors, having a conventional three point hitch. Heretofore, many types of hoists have been provided for use in conjunction with various types of vehicles. Many of these prior hoists are difficult to mount on and remove from the vehicles, such hoists being intended for substantially permanent mounting on special purpose vehicles adapted only for a particular load handling capability. Illustrative of such prior hoists are U.S. Pat. Nos. 2,462,926; 2,541,045; 2,684,159; 2,720,380; 2,919,107; 3,004,674; 3,092,259; and 3,289,855. Such hoists are either too expensive and/or lacking in versitility to be economically practical for farm use. Heretofore, hoists have also been provided for use in conjunction with tractors, such as farm tractors. U.S. Pat. Nos. 2,719,730 and 3,900,185 describe hoists with fixed position booms which angle upwardly from the point of attachment to the tractor and provide no flexibility of positioning of the boom for attachment of loads. U.S. Pat. No. 3,900,185 also illustrates and describes the use of a relatively complicated rachet and wheel or winch system for powering a cable to lift the load while U.S. Pat. No. 2,719,730 illustrates and describes the use of a hook on a cable which is lifted by a hydraulically extendible rod portion of a boom. U.S. Pat. No. 3,055,511 illustrates and describes the use of a boom on the side of a tractor wherein leverage is provided by cables and pulleys between the tractor, the boom and the load and wherein powered winches wind the cables so that arcuate movement of the boom toward and away from the ground is accomplished by means of the cables as in a derrick assembly. As is well known, cables are prone to breakage, and winches are often unreliable thereby causing safety problems.

An object of the present invention is to overcome the above as well as other disadvantages in prior hoists of the indicated character and to provide an improved hydraulic hoist particularly adapted for use in conjunction with a tractor having a conventional three point hitch.

Another object of the invention is to provide an improved hydraulically actuated hoist incorporating improved means for stabilizing the tractor and hoist when the hoist is in use.

Another object of the invention is to provide an improved hydraulically actuated hoist incorporating improved means for supporting the hoist, as for storage purposes, when the hoist is not in use.

Another object of the present invention is to provide an improved hoist which utilizes a hydraulically actuated piston and cylinder unit to pivot a boom toward and away from the ground, thereby eliminating the need for cables, winches and the like.

Another object of the invention is to provide an improved hoist which may be readily installed on and/or removed from a tractor with a minimum of time and labor and without requiring modification of the tractor.

Another object of the present invention is to provide an improved hoist which, when utilized with a tractor, is capable of lifting greater loads than prior hoists without danger of tipping the tractor.

Another object of the present invention is to provide an improved hoist which may be easily adjusted in length to regulate both the amount of stress placed on the boom of the hoist and the tractor in lifting heavy objects and to reach objects not closely approachable by the tractor.

Still another object of the present invention is to provide an improved hoist which is relatively simple in construction, economical to manufacture and assemble, durable, efficient and reliable in operation.

The above as well as other objects and advantages of the present invention will become apparent from the following description, the appended claims and the accompanying drawings.

DETAILED DESCRIPTION

In general, there is disclosed in the present application a novel hoist particularly adapted for mounting on a tractor, such as a farm tractor, having a conventional three point hitch including, as is well known in the art, dual vertically movable, hydraulically powered arms and a fixed bearing member disposed above and between the hydraulically powered arms. The novel hoist includes a generally inverted T-shaped base member having horizontally aligned attachment means adapted to be secured to the powered arms of the tractor hitch and additional attachment means adapted to be connected to the bearing member of the tractor three point hitch whereby the powered arms on the tractor can raise and lower the base member of the hoist. The novel hoist also includes a boom pivotally mounted on the vertically extending leg of the generally inverted T-shaped base member in a manner such that when the hoist is mounted on the tractor, the boom pivots in an arcuate path both toward and away from the ground. A powered actuating member is provided which is pivotally connected to the base member and to the boom so that the powered actuating member can move the boom in the aforementioned arcuate path. Swivel connecting means is also provided for attaching loads to the free end portion of the boom. The novel hoist is also provided with a pair of vertically extending support legs which are permanently fixed to the base member and extend downwardly therefrom, the support legs being adapted to be positioned on the ground to reduce the tendency of the tractor to tip towards the load when a load is secured to the end of the boom. The length of the boom is also adjustable, the boom including a pair of box beam section members, one of which members can be telescoped inside the other, and retaining means, such as a pin, is provided which extends through the box beam section members to hold the box beam section members in fixed relationship with respect to each other and thereby fix the length of the boom. A movable post is also provided which is pivotally connected to the end portion of the boom that is remote from the base member whereby the post and the support legs fixed to the base member provide a three point contact with the ground to support the hoist for storage purposes when the hoist is removed from the tractor. In addition, attachment means is provided on the base member whereby a wagon or other load bearing vehicle can be attached to the base member and positioned beneath the boom so that a load may be lowered onto such vehicle for movement by the tractor along the ground.

Figure 1:
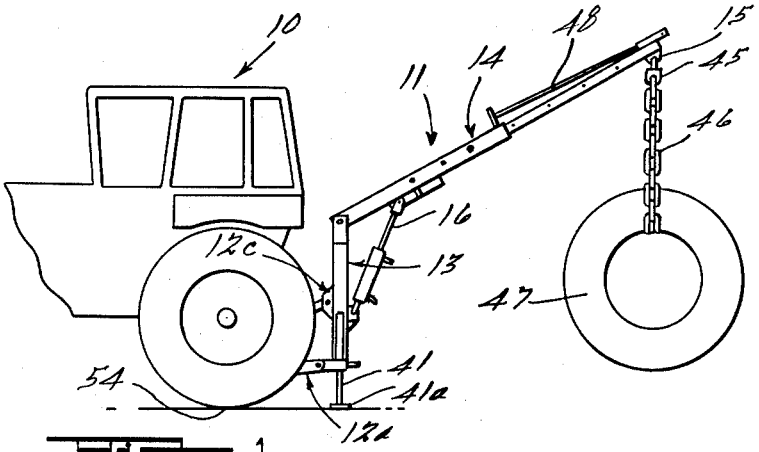
FIG. 1 is a side elevational view of a hoist embodying the present invention, showing the same mounted on a conventional three point hitch of a tractor and also illustrating the manner in which the hoist may be utilized to lift a relatively heavy load, such as a tractor tire.

Referring to FIG. 1 of the drawings, the rear end portion of a tractor, generally designated 10, is illustrated, to which is attached a hoist, generally designated 11, embodying the present invention. The hoist 11 includes three pivotal axes 12*a*, 12*b*, and 12*c*, which are connected to a conventional three point hitch on the tractor 10, as will be described hereinafter in greater detail. The hoist 11 also includes a base member, generally designated 13, a boom, generally designated 14, and a swivel load attachment means, generally designated 15. A hydraulically powered piston and cylinder actuating member 16 is provided which functions to move the boom 14 in an arcuate path toward and away from the ground for lifting purposes. The hoist 11 is preferably formed of steel or other material having sufficient strength to withstand the forces exerted thereon, and the base member 13 is preferably in the form of an inverted T having a horizontally extending portion 17 and a vertically extending portion 18. The lower pivotal axes 12*a* and 12*b* are provided by pins 19 which are mounted on identical plates 20 at the opposite ends of the horizontal portion 17 of the base member 13. The third upper pivotal axis 12*c* is provided by a channel 21, the web portion of which is welded to the vertical portion 18 of the base member 13. The flange portions of the channel 21 are provided with horizontally aligned openings adapted to receive a pin 22. The horizontal portion 17 and the vertical portion 18 of the base 13 are also preferably supported by identical diagonally extending struts 23, the lower end portions of which are welded to the horizontal portion 17 of the base while the upper end portions of the struts are welded to the vertical portion 18 of the base. Spaced plates 24 are fixed to the opposite sides of the upper end of the vertical portion 18 of the base, and a pivot pin 25 is provided which extends horizontally through the plates 24, the pivot pin 25 supporting the boom 14 for arcuate movement toward and away from the ground.

The boom 14 includes a pair of boom members 26 and 27 each having a box beam section, the boom member 27 being smaller in cross section than the boom member 26 whereby the boom member 27 is slidable within the boom member 26 so that the boom 14 can be telescoped to increase and decrease the length thereof. Holes 29 are provided through opposite sides of the boom member 26 which align with holes 30 provided in the opposite sides of the boom member 27 so that pins, such as 28, may be inserted through aligned holes 29 and 30 to lock the boom members 26 and 27 together at a selected length.

Figure 2:
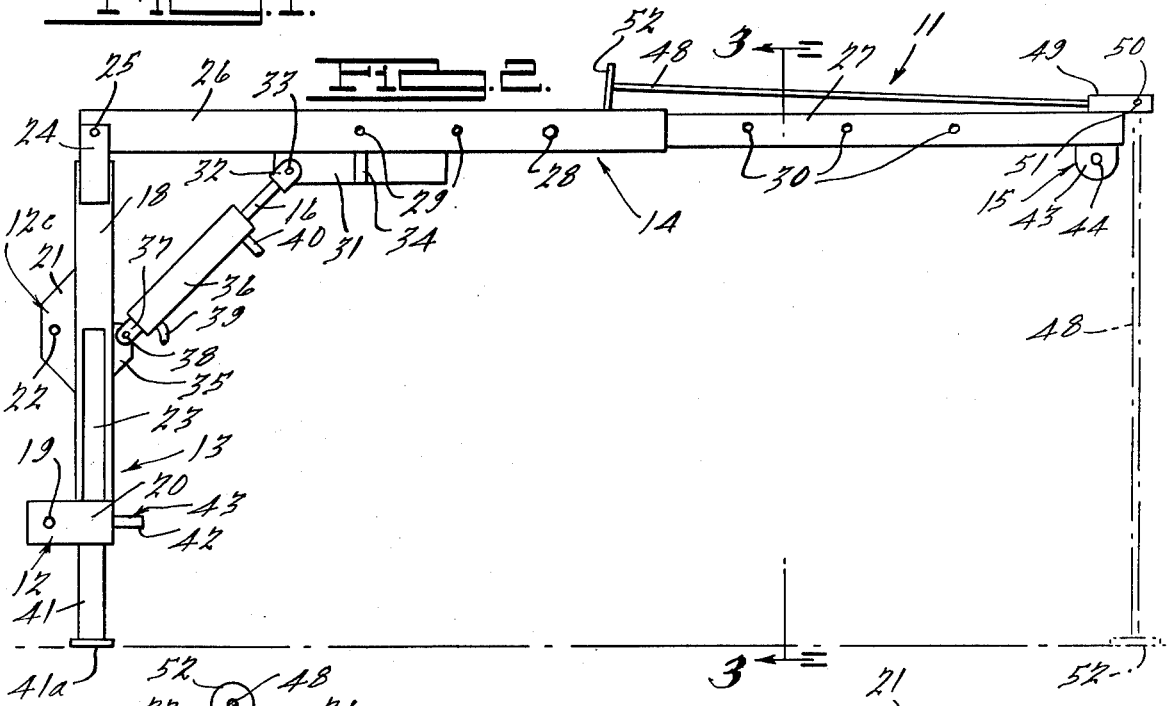
FIG. 2 is an enlarged side elevational view of the hoist illustrated in FIG. 1, showing the same removed from the tractor.
Figure 3:
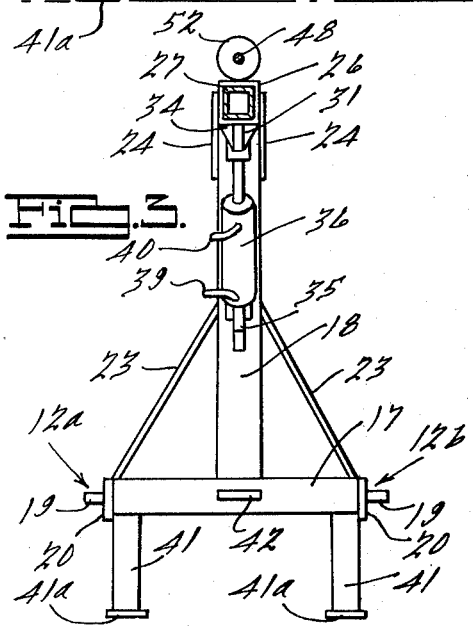
FIG. 3 is a sectional elevational view of the structure illustrated in FIG. 2, taken on the line 3—3 thereof.

The powered actuating member 16 is pivotally attached to the boom member 26 by means of a plate 31 which is mounted longitudinally along the outside and the underside of the boom member 26. The actuating member 16 includes a clevis 32 and a pin 33 extends through the plate 31 and the clevis 32. As shown in FIG. 2, the clevis 32 is positioned at a position near but spaced from the end of the plate 31 closest to the boom pivot pin 25, and reinforcement gussets 34 are provided on opposing sides of the plate 31 and boom member 26 to increase the strength of the boom. A plate 35 is provided which is welded to the vertically extending portion 18 of the base 13 at a position opposite the channel 21 for mounting the hydraulic cylinder 36 of the actuating member 16, the hydraulic cylinder 36 being provided with a clevis 37 adapted to receive a pivot pin 38 which extends through the clevis 37 and the plate 35. The actuating member 16 is actuated by hydraulic fluid supplied under pressure from the tractor through conduits 39 and 40 to raise and lower the boom 14.

A pair of vertically extending support legs 41 are provided which are welded to the horizontally extending portion 17 of the base member 13, the lower end portions of the support legs 41 being provided with pads 41*a* which increase the ground engaging area of the legs 41 and which can be positioned on the ground to reduce the tendency of the tractor to tip towards the load when a heavy load is secured to the end of the boom.

A rearwardly projecting plate 42 is provided which is welded to the horizontally extending portion 17 of the base 13 as illustrated in the drawings, the plate 42 being provided with a vertically disposed passageway 42*a* which facilitates attachment of a load carrying vehicle such as a wagon (not shown) that may be utilized to carry a load that has been lowered thereon through the agency of the boom 14.

Preferably the load attachment means 15 is provided adjacent the free end of the smaller boom member 27. As shown in FIGS. 1 and 2, the attachment means 15 is comprised of a plate 43 having a hole 44 extending therethrough adapted to receive a swivel hook 45 to which may be attached a chain 46 adapted to lift a load such as a tractor tire 47.

An elongate support post 48 is also provided which is pivotally connected to the free end portion of the boom 14 through the agency of a pair of spaced plates 49 which are welded to the upper side of the boom member 27 and project longitudinally outwardly therefrom, the plates 49 being provided with aligned openings 50 adapted to receive a pivot pin 51 which also projects through the adjacent end portion of the support post 48. A ground engaging pad 52 is fixed to the opposite end of the support post 48. The support post 48 is shown in a rest position in solid lines in FIG. 2 whereby the support post extends along the upper side of the boom 14 when the support post is not in use. The support post 48 may be pivoted to a vertically extending position shown in dotted lines in FIG. 2 wherein the pad 52 engages the ground. With the support post 48 in the vertically extending position illustrated in FIG. 2, the support post 48 and the support legs 41 are tripodal and support the hoist 11, as for storage purposes, when the hoist is removed from the tractor 10. Such a construction greatly facilitates attaching the hoist to and removing the hoist from the tractor.

Figure 4:
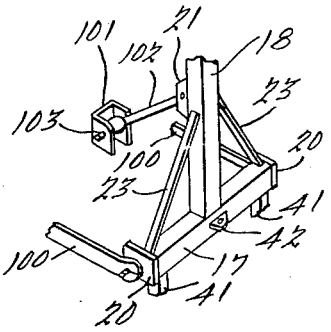
FIG. 4 is a perspective view of a portion of the structure illustrated in FIG. 1.
Figure 5:
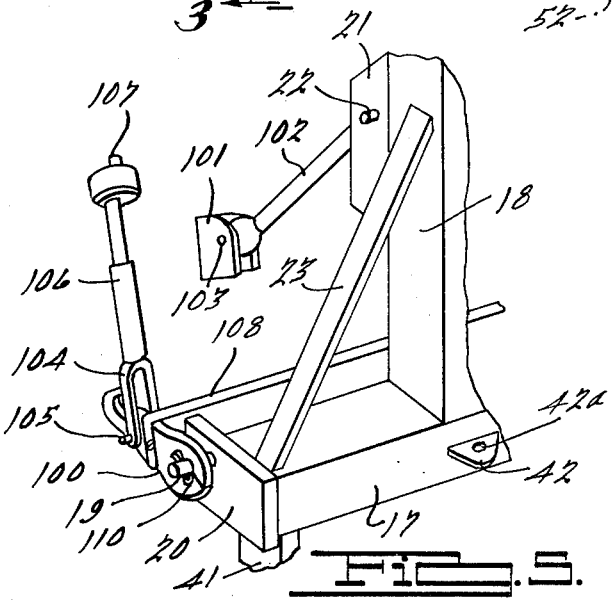
FIG. 5 is an enlarged perspective view of a portion of the structure illustrated in FIG. 4.

The conventional three point hitch of the tractor 10 is shown in FIGS. 4 and 5 and is schematically illustrated, such conventional three point hitch commonly being provided on tractors in the range of about forty to one hundred twenty five horsepower. Tractors in this horsepower range are heavy enough to permit lifting of significant loads by means of the boom 14. Since the load is disposed at the distal end of the boom 14, the moment arm for the load extends from the area 54 where the wheels of the tractor 10 touch the ground to the end of the boom when the legs 41 are not supported on the ground. However, such moment arm is reduced when the pads 41*a* of the support legs 41 are in contact with the ground and at the same time the moment arm of the bulk of the weight of the tractor is increased thereby increasing the ability of the tractor to counteract the weight of the load suspended from the boom 14.

The conventional and schematically illustrated three point hitch of the tractor 10 includes a pair of vertically movable, openable jaw bearing members 100 disposed on opposite sides of the tractor and adapted to receive the pins 19 of the hoist 11. The three point hitch also includes a fixed support 101, and a support arm 102 is provided, one end portion of which pivots on the pin 22 while the opposite end of the support arm 102 is pivotally attached to the fixed tractor support 101 through the agency of a pin 103. The combination of the movable jaw bearing members 100 and the pivotally mounted support arm 102 thus provides for raising and lowering movement of the base member 13.

A yoke 104 is attached by a pin 105 to each bearing member 100, and a hydraulic piston and cylinder unit 106, connected to the yoke 104, is activated by means of a hydraulic line 107 to raise and lower the bearing members 100. A bar 108 is also provided for opening and closing the jaw bearing members 100, and the pins 19 are held in the jaw bearing members 100 by cotter keys 100.

In operation, the hoist 11 is connected to the three point hitch of the tractor 10 in the manner previously described, and the hydraulic piston and cylinder unit 36 is connected to the conventional tractor hydraulic power supply through the lines 39 and 40. A load, such as the tractor tire 47, may then be attached to the end of the boom 14, as for example, through the agency of the swivel connection 45 and chain 46, the swivel connection 45 permitting the load to be oriented in any desired direction. If the load is relatively light in weight, lifting can be accomplished by raising the bearing members 100 of the three point hitch by actuating the hydraulic piston and cylinder unit 106 and/or by raising the boom 14 by actuating the hydraulic piston and cylinder unit 36 to extend the rod 16. In this mode of operation, the pads 41*a* need not be on the ground and the load can be moved simply by moving the tractor 10. For heavier loads, the bearing members 100 are lowered so as to plant the pads 41*a* of the support legs 41 firmly on the ground. The load can then be attached to the boom 14 and the hydraulic piston and cylinder unit 36 activated so as to extend the rod 16 and lift the boom 14 thereby reducing the effective moment arm of the load so that the bulk of the tractor can counterbalance the weight of the load when the support legs 41 are lifted. The load can then be moved by moving the tractor after which the support legs 41 are again lowered to the ground before the boom is lowered to lower the load. The load can also be lowered onto a wagon or other wheeled vehicle connected to the attachment means 42 and the load moved by the wagon pulled by the tractor.

While a preferred embodiment of the invention has been illustrated and described, it will be understood that various changes and modifications may be made without departing from the spirit of the invention.

What is claimed is:

1. A hydraulically actuated hoist adapted for mounting on a farm tractor having a three point hitch, said hoist comprising, in combination, a base of generally inverted T-shaped configuration and including a horizontally extending portion and a vertically extending portion, strut means extending diagonally between said horizontally extending portion and said vertically extending portion of said base, a telescopic boom including a first box beam section having one end portion thereof pivotally connected to said vertically extending portion of said base, a second box beam section telescopically disposed within said first box beam section and having means fixedly mounted at one end thereof for attaching a load thereto, means for locking said first and second box beam sections in any one of a plurality of selected positions relative to each other, a hydraulic piston and cylinder unit having one end portion thereof pivotally connected to said base and the other end portion thereof pivotally connected to said boom, said piston and cylinder unit being operable to raise and lower said boom, a pair of vertically extending support legs fixed to said horizontally extending portion of said base and projecting downwardly therefrom, an elongate support post pivotally connected to the end portion of said second box beam section, ground engageable pad means secured to the free end portions of said legs and post, said post being adapted to overlie said boom and being pivotable to a vertically extending position whereby said post and said legs cooperate to form a tripodal support for said hoist when said hoist is disconnected from said hitch, and means for releasably connecting said base to said three point hitch.

2. The combination as set forth in claim 1 including means for attaching a vehicle to said horizontally extending portion of said base.

3. The combination as set forth in claim 1, said means for releasably connecting said base to said three point hitch including spaced pin means.

4. The combination as set forth in claim 1, said means for attaching a load including swivel means.

* * * * *